US006032750A

United States Patent [19]

Kersten et al.

[11] Patent Number: 6,032,750

[45] Date of Patent: Mar. 7, 2000

[54] DRILLING TOOL HAVING A DRILL BIT WITH PRIMARY AND SECONDARY CUTTING EDGES

[75] Inventors: Heinrich Kersten, Verden; Hartmut Precht, Dinklage, both of Germany

[73] Assignee: Gebrueder Heller Dinklage GmbH, Dinklage, Germany

[21] Appl. No.: 08/945,677

[22] PCT Filed: May 8, 1996

[86] PCT No.: PCT/DE96/00868

§ 371 Date: Feb. 4, 1998

§ 102(e) Date: Feb. 4, 1998

[87] PCT Pub. No.: WO96/35856

PCT Pub. Date: Nov. 14, 1996

[30] Foreign Application Priority Data

May 9, 1995 [DE] Germany ..... 195 16 270

[51] Int. Cl.[7] ..... E21B 10/00

[52] U.S. Cl. ..... 175/398; 175/397; 175/420.1; 175/427; 408/223; 408/227; 408/230

[58] Field of Search ..... 175/269, 417, 175/430, 379, 429, 332, 431, 420.1, 427, 398, 397; 408/145, 144, 223, 224, 230, 227, 228, 229

[56] References Cited

U.S. PATENT DOCUMENTS

| | | | |
|---|---|---|---|
| 2,567,084 | 9/1951 | Stokes | 175/397 X |
| 2,673,714 | 3/1954 | Hargrave | 175/397 X |
| 4,727,946 | 3/1988 | Barr et al. | 175/379 |
| 4,787,464 | 11/1988 | Ojanen | 175/57 |
| 4,951,761 | 8/1990 | Peetz et al. | 175/398 |
| 4,967,855 | 11/1990 | Moser | 405/230 |
| 5,314,272 | 5/1994 | Kubota | 408/224 |

FOREIGN PATENT DOCUMENTS

| | | |
|---|---|---|
| 0 347 602 | 12/1989 | European Pat. Off. . |
| 29 12 394 | 10/1980 | Germany . |
| 29 52 296 | 6/1981 | Germany . |
| 961449 | 6/1964 | United Kingdom . |

*Primary Examiner*—David Bagnell
*Assistant Examiner*—Jong-Suk Lee
*Attorney, Agent, or Firm*—Hill & Simpson

[57] ABSTRACT

Drilling tool with a drill head with an end face pointing in the feed direction and which has a main bit, which forms a drill point located in the drill axis and the bit is inclined on either side in a substantially roof-shaped manner and the tool has drilling dust grooves. The main bit has a primary cutting edge, which extends radially over at least one side of the main bit, and a secondary cutting edge, which extends radially over substantially the remaining length of the main bit and is axially set back with respect to the primary cutting edge counter to the feed direction by at least the amount of feed in millimeters per revolution.

11 Claims, 2 Drawing Sheets

DRILLING TOOL HAVING A DRILL BIT WITH PRIMARY AND SECONDARY CUTTING EDGES

BACKGROUND OF THE INVENTION

The present invention relates to a drilling tool with a drill head having an end face which is directed in the feed direction and which face has a main bit forming a drill point located on the drill axis and which bit is inclined in substantially a roof-shaped manner on either side, and the head has drilling dust grooves.

For example German patents 43 38 677 and 35 00 202 disclose drilling tools with a main bit which extends over the entire drill head of the drilling tool determine the hole diameter and which bit is constructed in a radially and axially symmetrical manner as a cutting element. Such drilling tools give an unsatisfactory drilling rate and/or require high force expenditure. In addition, a symmetrical cutting edge construction can give rise to transverse vibrations, which can lead to a geometrically non-uniform hole shape.

SUMMARY OF THE INVENTION

The problem which is being solved by the invention is to provide a drilling tool of the aforementioned type which tool permits the obtaining of a higher drilling rate and circular holes.

According to the invention this problem is solved in that the main bit has a primary cutting edge extending radially over at least one side of the main bit and a secondary cutting edge extending radially substantially over the remaining length of the main bit and which secondary cutting edge is axially set back with respect to the primary cutting edge counter to the feed direction by at least the amount of drilling feed in millimeters per revolution.

Advantageously the axial displacement of the secondary cutting edge with respect to the primary cutting edge is chosen as a function of the material characteristics of the material to be drilled. The secondary cutting edge is advantageously set back by approximately 0.3 to 1.5 mm relative to the primary cutting edge.

Preferably the length of the secondary cutting edge is chosen as a function of the material characteristics of the material to be drilled.

Additionally the drilling tool can have at least one additional cutting element.

According to a special embodiment of the invention, the two sides of the main bit emanating from the drill tip can have different lengths, with the long side extending beyond the circumferential contour of the body, the primary cutting edge extending radially over at least the long side of the main bit and the secondary cutting edge extending radially over substantially the remaining length of the main bit. The drilling tool has at least two additional cutting edges, which are arranged substantially symmetrically under an angle to the main cutting edge axis, whose cutting axes intersect the main cutting edge axis on the drill axis of the drill head and whose radially outer ends are located on the same rotation circle as the radially outer end of the primary cutting edge and together define the nominal drilled diameter, whilst the radially outer end of the secondary cutting edge is moved radially inward. The additional cutting edges over at least part of their cutting lengths are set back in the feed direction from the primary cutting edge and extend ahead of the secondary cutting edge in the feed direction.

The radially outer end of the short side of the main bit with the secondary cutting edge projects over and beyond the circumferential contour of the body.

The radially outer end of the short side of the main bit with the secondary cutting edge may not project beyond the circumferential contour of the body.

In particular, the radially outer end of the short side of the main bit with the secondary cutting edge is drawn radially inwards from the circumferential contour of the body.

Preferably the primary cutting edge extends over ⅝ to ¾ of the nominal drilled diameter.

The angle between the additional cutting edge and the main bit is preferably 20 to 70°.

In addition, the angle ($\alpha$) between the additional cutting edge and the main bit is chosen as a function of the drilling dust volume obtained.

Drilling dust grooves can be positioned upstream of the additional cutting edges in the rotation direction. In addition, further drilling dust grooves can be positioned behind the additional cutting edges.

The cross-section of the drilling dust grooves can be chose as a function of the dust quantity produced per unit of time.

According to a special embodiment of the invention, the additional cutting edges envelop pins.

Finally, the drilling tool can have a feed helix.

The invention is based on the surprising finding that as a result of the set back secondary cutting edge, the effective cutting length of the drilling tool for a constant drilling diameter is reduced and consequently the rock removal quotient (force/cutting length) is linearly increased. Therefore the drilling tools operate much faster than the prior art drilling tools and consequently the drive units (electrical, internal combustion engine or compressed air-operated drilling drives) and also the human operators are "protected". Thus, specifically in the upper diameter range of an authorized drilling diameter for a special machine, the upper limit can be safely reached or exceeded without overloading the machine. By adding at least one additional cutting element, the possibility exists of adapting the drilling tool to the operating requirements.

The special embodiment, which has at least two additional cutting edges and the secondary cutting edge terminating radially inward of the primary cutting edge and the additional cutting edges, also has the advantage that the inventive design of the drilling tool with at least four cutting edges, whereof only three define the contour of the hole, makes it possible to obtain geometrically round holes, because a circle is not geometrically overdefined by three points.

In addition, these three radially outer points leads to reduced friction compared with a four-flute drill. The passive force distribution of the selected main bit geometry ensures a lateral engagement of the additional cutting edges in the hole wall.

Compared with a double-edged tool with a through bit, in the case of the selected form at a higher circumferential speed or with a longer path several cutting edges are in use, so that the wear suffered by each cutting edge is reduced.

Further features and advantages of the invention can be gathered from the following description of a non-limitative embodiment, the following description and the claims; with reference to the attached drawings, wherein show:

DESCRIPTION OF THE PREFERRED EMBODIMENTS

Figure 1:
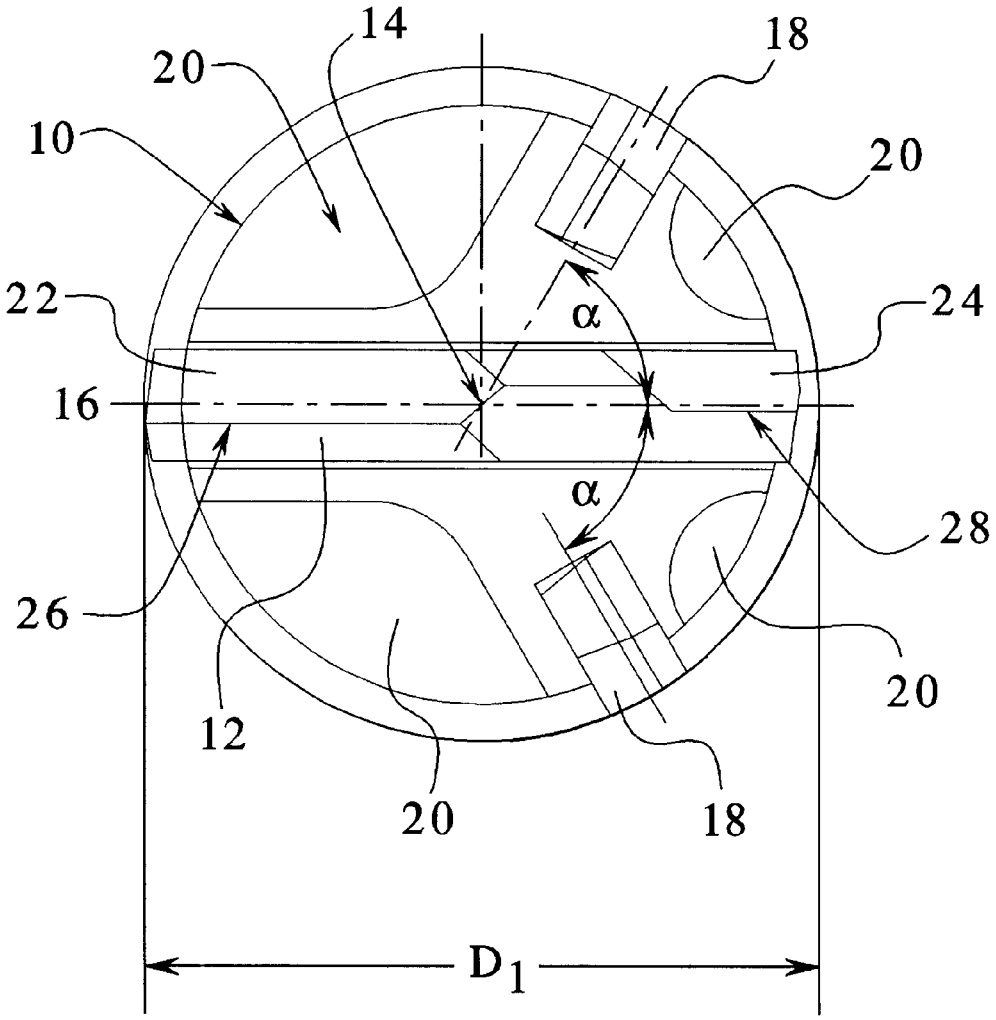
FIG. 1 is a plan view of the end faces of a drilling tool according to the invention.

A drilling tool according to the present invention has a body 10 with an end face having a main bit 12, which forms a drill point 14 located in the drill axis and on either side has a substantially roof-like inclination. Two additional cutting edges 18 are provided on the main bit symmetrical to a main cutting axis 16 and these edges 18 extend at an angle $\alpha$ of 60° to the axis 16 and have their cutting axes intersecting the main cutting axis 16 in the drill axis of the drill head. There are drilling dust grooves 20 between the main bit 12 and the additional cutting edges 18.

Starting from the drill point 14, the main bit 12 has a long side 22, which extends beyond the circumferential contour of the body 10, and a short side 24, which admittedly extends over the circumferential contour of the body, but relative to the center axis of the tool is shorter than the long side 22. The main bit 12 has a primary cutting edge 26 extending over ⅝ of the nominal drilled diameter D1, i.e. over the long side 22 and part of the short side 24, as well as a secondary cutting edge 28 extending over the remaining length of the short side 24.

The main bit according to the invention, which fundamentally assumes the main guidance work and the essential part of the tool work has, compared with a prior art drilling tool a much higher rock removal quotient due to the shortening of the effective cutting length for the same drilling diameter, so that the drilling tool operates much faster. The radially outer ends of the additional cutting edges 18 are on the same rotation circle with a diameter $D_1$, which corresponds to the nominal drilling diameter of the drilling tool, as the radially outer end of the primary cutting edge 26.

Figure 2:
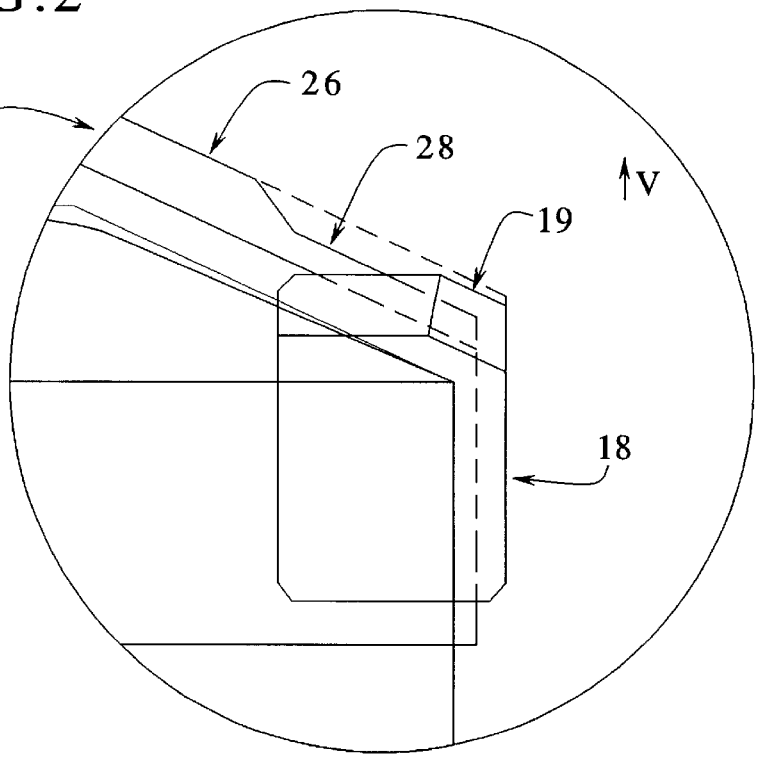
FIG. 2 is an enlarged side view of a portion of the drilling tool of FIG. 1.

FIG. 2 shows a portion of a side of the drilling tool of FIG. 1, which portion includes part of the short side 24 of the main bit 12 and one of the two additional cutting edges 18. The primary cutting edge 26 extends over the long side 22 and part of the short side 24 over a total of ⅝ of the nominal drilled diameter D1. To this is connected the secondary cutting edge 28, which is set back axially counter to the drilling feed direction V compared with the primary cutting edge 26 and its radially end is set back relative to the radially outer end of the primary cutting edge 26. The additional cutting edges 18 comprise bits, whose edges 19 in the embodiment shown are essentially parallel to the cutting edges of the primary edge 26 and secondary edge 28, but in the drilling feed direction V project ahead or above the secondary cutting edge 28 and are set back behind or below the primary cutting edge 26. In the case of special cutting edge forms, such as pins with a cone, frustum, etc., the configuration of the cutting edge is between the primary cutting edge 26 and the secondary cutting edge 28.

Figure 3:
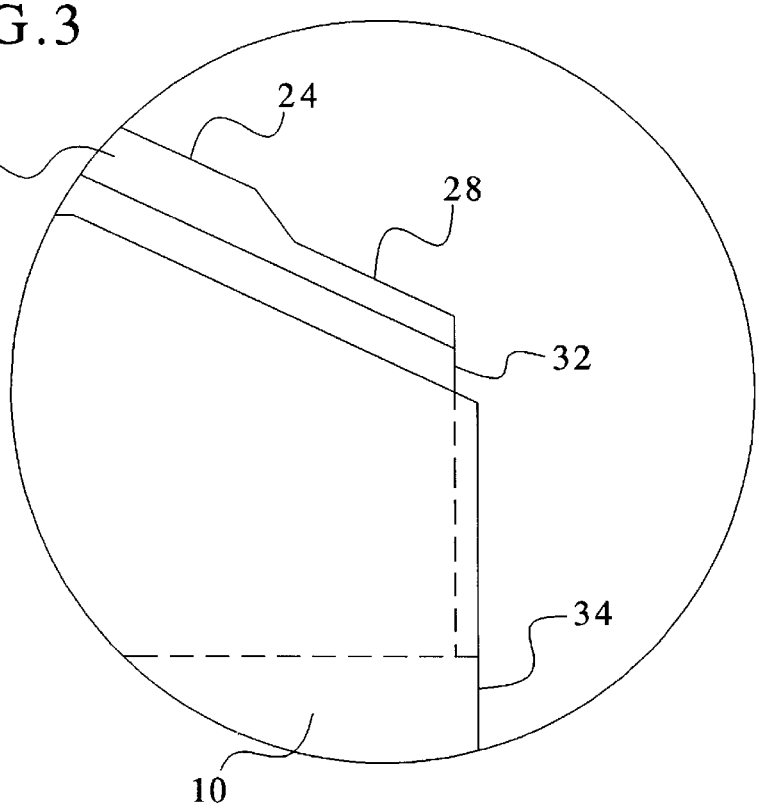
FIG. 3 is an enlarged partial side view of a modification of the portion of the drilling tool of FIG. 1.

In a modification of FIG. 3, a radial outer end 32 of the short side 24 with the secondary cutting edge 28 is drawn radially inward from the circumferential contour or outer surface 34 of the body 10. This end 32 does not project beyond the circumferential contour of the body 10.

Such a drill with four or more cutting edges provides circular holes, because compared with a conventional four-flute drill, only three points, namely the radially outer ends of the primary cutting edge 26 and additional cutting edges 18 are used to provide a circular hole.

The preferred values of 0.3 to 1.5 mm for the setting back of the secondary cutting edge 28 compared with the primary cutting edge 26 can be obtained in rock-specific manner in accordance with the standard drilling rate.

We claim:

1. A drilling tool with a drill head with an end face pointing in the feed direction and having a main bit, which forms a drill point located on the drill axis between two sides and which sides are inclined in substantially a roof-shaped manner, and said head having drilling dust grooves, the improvement comprising the main bit having a primary cutting edge extending radially over one side and into the other side of the main bit and between ⅝ and ¾ of a nominal drilled diameter, said main bit having a secondary cutting edge extending radially over substantially the remaining length of the main bit and being axially set back with respect to the primary cutting edge opposite to an axial direction by at least an amount of the feed in millimeters per revolution.

2. The drilling tool according to claim 1, wherein the secondary cutting edge is set back by approximately 0.3 to 1.5 mm with respect to the primary cutting edge.

3. The drilling tool according to claim 1, which includes at least one additional cutting element.

4. A drilling tool with a drill head with an end face pointing in the feed direction and hiving a main bit which forms a drill point located on the drill axis between two sides which sides are inclined in substantially a roof-shaped manner, and said head having drilling dust grooves, the improvement comprising the main bit having a primary cutting edge, a secondary cutting edge and a main cutting edge axis, the two sides of the main bit extending from the drill point having different lengths with a long side extending beyond a circumferential contour of a body of the drill head and lying on a circle having a diameter greater than a diameter of the body, the primary cutting edge extending radially over at least the long side of the main bit and into the short side of the main bit and the secondary cutting edge being on the short side, and extending radially over substantially the remaining length of the main bit, said secondary cutting edge being axially set back with respect to the primary cutting edge opposite to an axial direction by at least an amount of the feed in millimeters per revolution, and the drilling tool having at least two additional cutting edges with cutting edge axes being arranged symmetrical at an angle to the main cutting edge axis and intersecting the main cutting edge axis at the drill point, said additional cutting edges having radial outer ends lying on said circle and coacting with the radial end of the primary cutting edge to define the nominal drilling diameter of the tool, the radial outer end of the secondary cutting edge being disposed radially inward of said circle and the additional cutting edges over at least a portion of their cutting length being axially positioned between the axial position of the primary cutting edge and the secondary cutting edge.

5. The drilling tool according to claim 4, wherein the radially outer end of the short side of the main bit with the secondary cutting edge projects over the circumferential contour of the body.

6. The drilling tool according to claim 1, wherein outer edge of the short side of the main bit with the secondary cutting edge does not project beyond the circumferential contour of the body.

7. The drilling tool according to claim 6, wherein the radially outer end of the short side of the main bit with the secondary cutting edge is drawn radially inwards from the circumferential contour of the body.

8. The drilling tool according to claim 4, wherein the primary cutting edge extends over ⅝ to ¾ of the nominal drilled diameter.

9. The drilling tool according to claim 4, wherein the angle between each additional cutting edge and the main bit is between 20 to 70°.

10. The drilling tool according to claim 4, wherein the drilling dust grooves are positioned upstream of the additional cutting edges in the rotation direction.

11. The drilling tool according to claim 10, wherein additional drilling dust grooves are positioned behind the additional cutting edges.

* * * * *